US011033170B2

(12) United States Patent
Riddle et al.

(10) Patent No.: US 11,033,170 B2
(45) Date of Patent: Jun. 15, 2021

(54) SUMP MOUNTING ASSEMBLY HAVING ONE OR MORE LATCHES

(71) Applicant: Haier US Appliance Solutions, Inc., Wilmington, DE (US)

(72) Inventors: Brian Steven Riddle, Taylorsville, KY (US); Steven Chadwick Koepke, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/402,526

(22) Filed: May 3, 2019

(65) Prior Publication Data

US 2020/0345202 A1 Nov. 5, 2020

(51) Int. Cl.
*A47L 15/42* (2006.01)

(52) U.S. Cl.
CPC ..... *A47L 15/4225* (2013.01); *A47L 15/4246* (2013.01); *A47L 15/4208* (2013.01)

(58) Field of Classification Search
CPC ..... A47L 15/4208; A47L 15/4225; A47L 15/4246
USPC ..... 134/56 D, 57 D, 58 D
See application file for complete search history.

(56) References Cited

U.S. PATENT DOCUMENTS

| | | | |
|---|---|---|---|
| 5,118,254 | A | 6/1992 | Ellingson et al. |
| 6,877,962 | B2 | 4/2005 | Turner et al. |
| 7,694,689 | B2 | 4/2010 | Woo |
| 2005/0120533 | A1 | 6/2005 | Yoon et al. |
| 2006/0054195 | A1 | 3/2006 | Yoon et al. |

*Primary Examiner* — Levon J Shahinian
(74) *Attorney, Agent, or Firm* — Dority & Manning, P.A.

(57) ABSTRACT

A sump mounting assembly for mounting a sump with the tub of a dishwasher appliance is provided herein. The sump mounting assembly may include a sump having a seal extending around the side of the sump, one or more latch receivers mounted to the bottom side of the sump, and one or more latches rotatably attached to the latch receivers, wherein rotation of the latch causes compression of the seal, thereby sealing the tub.

18 Claims, 13 Drawing Sheets

FIG. —7—

SUMP MOUNTING ASSEMBLY HAVING ONE OR MORE LATCHES

FIELD OF THE INVENTION

The present subject matter generally relates to a sump mounting assembly for an appliance and, more particularly, to the use of one or more latches mounted to a sump.

BACKGROUND OF THE INVENTION

Dishwasher appliances employ spray arms to introduce wash fluid into a washing tub. To significantly reduce the volume of water used in a given wash cycle, most dishwasher appliances include a sump located at the base of the washing tub which, among other things, collects wash fluid that has been sprayed into the washing tub and recycles it by directing the wash fluid back to the spray arms for further use. Because the sump is generally located at the base of the dishwasher appliance (e.g., in order that wash fluid properly drains into the sump) proper mounting of the sump is important to prevent leaks. It is therefore common to mount the sump into the washing tub along with a seal that is compressed during the sump mounting process.

One common technique for mounting the sump into the tub involves the time-consuming step of driving multiple screws or bolts through bosses molded to the bottom surface of the sump. To speed the assembly process, the step of inserting the screws or bolts is typically accomplished using a pressure activated drill. Use of such drills, however, comes with the risk of missing the boss or applying too much torque, which can result in damage to the sump itself. Thus, a certain number of sumps must be discarded as scrap and the process must be repeated using a new sump, increasing the time and material costs associated with manufacturing the product.

Accordingly, it would be useful to provide an appliance including features addressing one or more of the above-identified issues. In some cases, an appliance having a sump mounting assembly that could be manufactured while limiting assembly time and costs would be desirable.

BRIEF DESCRIPTION OF THE INVENTION

Aspects and advantages of the invention will be set forth in part in the following description, or may be obvious from the description, or may be learned through practice of the invention.

In exemplary aspect of the present disclosure, a sump mounting assembly is provided. The sump mounting assembly may include a sump, a seal, and one or more latches that may be rotatably mounted to the sump. The sump may further include a top, a bottom, a side extending between the top and the bottom, and a latch receiver. The latch receiver may further include a latch post having a first post end connected to the bottom and a second post end displaced from the bottom of the sump. The latch receiver may further include a latch retainer having a first retainer end connected to the second post end and a second retainer. The seal may extend around the side of the sump. The latch may be rotatably mounted to the latch receiver. At least a portion of the latch may extend beyond the side of the sump and seal in order to maintain the position of the sump.

In other exemplary aspects of the present disclosure, a dishwasher appliance is provided. The dishwasher appliance may include a cabinet having a front cabinet opening, a hinged door for accessing and sealing the front cabinet opening, a wash tub that defines a wash chamber, one or more spray assemblies for introducing wash fluids into the wash chamber, and a sump mounting assembly. The wash tub may further include an interior bottom surface having a tub opening and a tub lip extending below the interior bottom surface and defining the tub opening. The sump mounting assembly may further include a sump, a seal, and one or more latches that may be rotatably mounted to the sump. The sump may further include a top, a bottom, a side extending between the top and the bottom, and a latch receiver. The latch receiver may further include a latch post having a first post end connected to the bottom and a second post end displaced from the bottom of the sump. The latch receiver may further include a latch retainer having a first retainer end connected to the second post end and a second retainer. The seal may extend around the side of the sump. The latch may be rotatably mounted to the latch receiver. At least a portion of the latch may extend beyond the side of the sump and seal in order to maintain the position of the sump.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
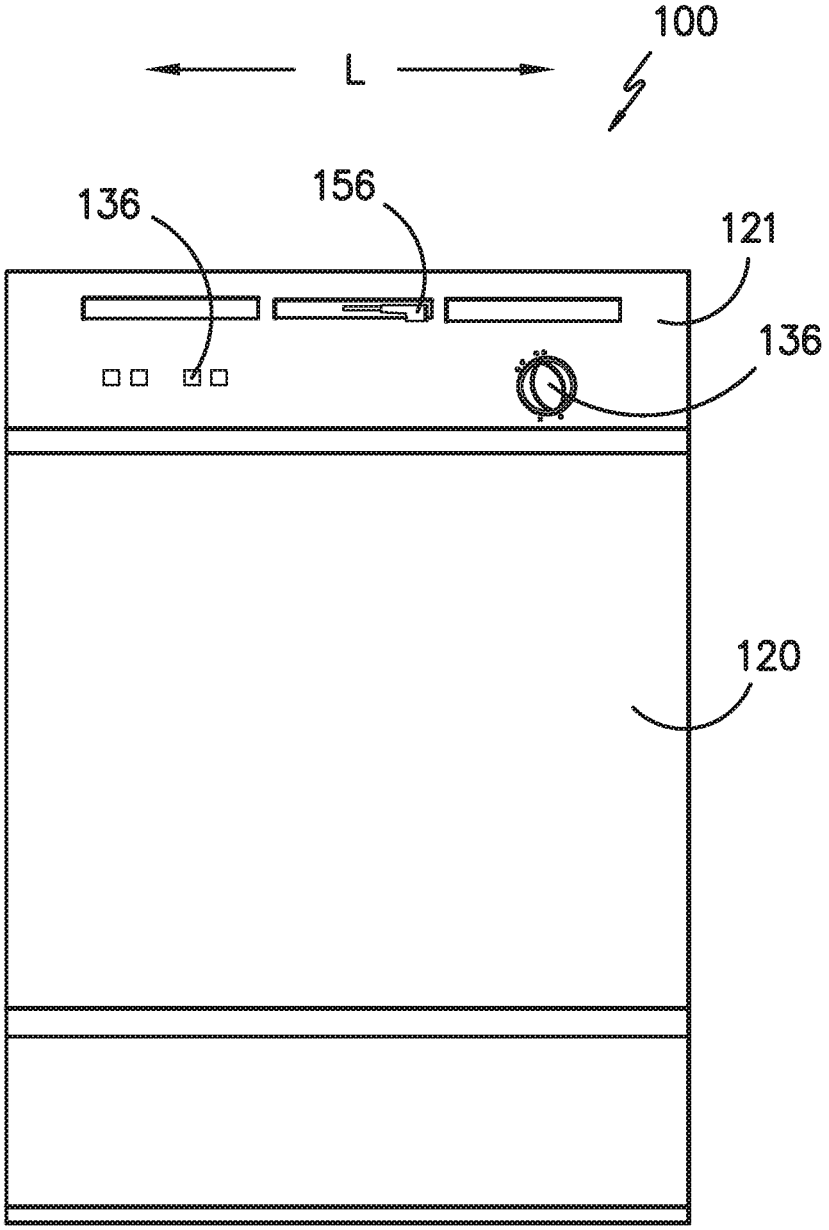
FIG. 1 provides a front view of an exemplary dishwasher appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
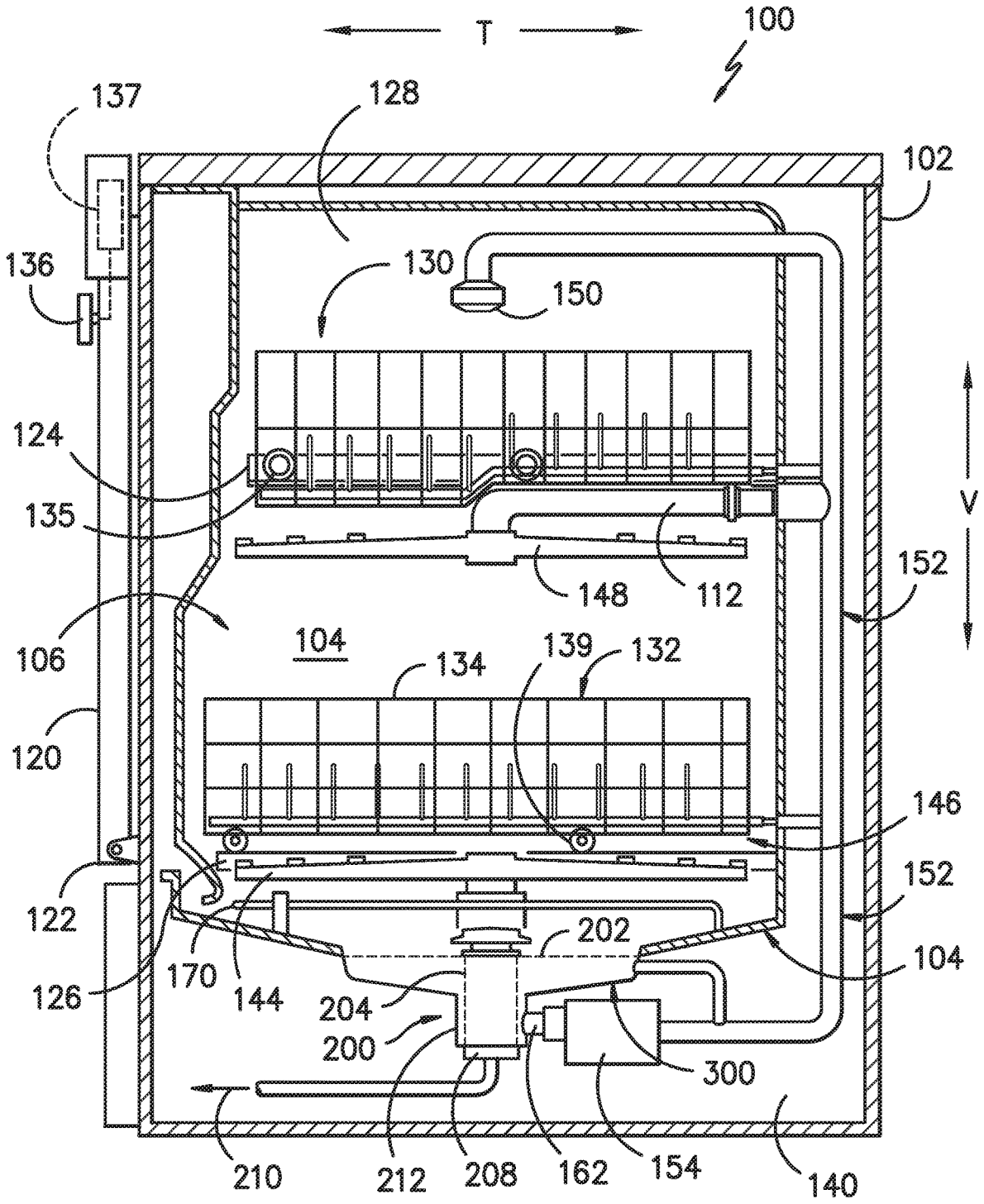
FIG. 2 provides a cut away side view of an embodiment of the dishwasher appliance.

FIGS. 1 and 2 depict an exemplary domestic dishwasher 100 that may be configured in accordance with aspects of the present disclosure. As illustrated in FIGS. 1 and 2, exemplary embodiments of the dishwasher 100 include a cabinet 102 having a tub 104 therein that defines a wash chamber 106. The tub 104 includes a front cabinet opening (not shown) and a door 120 hinged at its bottom 122 for movement between a normally closed vertical position (shown in FIGS. 1 and 2), wherein the wash chamber 106 is sealed shut for washing operations, and a horizontal open position for loading and unloading of articles from the dishwasher 100. Latch 156 is used to lock and unlock door 120 for access to wash chamber 106.

In some embodiments, upper and lower guide rails 124, 126 are mounted on tub side walls 128 and accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown), in which the rack 130 or 132 is substantially positioned outside the wash chamber 106, and a retracted position (shown in FIGS. 1 and 2), in which the rack 130 or 132 is located inside the wash chamber 106. This rack movement is facilitated by rollers 135 and 139, for example, mounted onto racks 130 and 132, respectively. A silverware basket (not shown) may be removably attached to rack assembly 132 for placement of silverware, utensils, and the like that are otherwise too small to be accommodated by the racks 130, 132.

In certain embodiments, the dishwasher 100 further includes a lower spray-arm assembly 144 that is rotatably mounted within a lower region 146 of the wash chamber 106 and above a tub sump assembly 300 so as to rotate in relatively close proximity to rack assembly 132. Additionally or alternatively, a mid-level spray-arm assembly 148 may be located in an upper region of the wash chamber 106 and may be located in close proximity to upper rack 130. Also additionally or alternatively, an upper spray assembly 150 may be located above the upper rack 130.

The lower and mid-level spray-arm assemblies 144, 148 and the upper spray assembly 150 may be part of a fluid circulation assembly 152 for circulating water and dishwasher fluid in the tub 104. The fluid circulation assembly 152 may also include a recirculation pump 154 positioned in a machinery compartment 140 located below the tub sump assembly 300 (e.g., bottom wall) of the tub 104. Pump 154 may receive fluid from sump assembly 300 to provide a flow to fluid circulation assembly 152, or optionally, a switching valve or diverter (not shown) may be used to select flow. A heating element 170 can be used to provide heat during e.g., a drying cycle.

Each spray-arm assembly 144, 148 may include an arrangement of discharge ports or orifices for directing washing fluid received from pump 154 onto dishes or other articles located in rack assemblies 130 and 132. The arrangement of the discharge ports in spray-arm assemblies 144, 148 can provide a rotational force by virtue of washing fluid flowing through the discharge ports. The resultant rotation of the spray-arm assemblies 144, 148 and the operation of spray assembly 150 using fluid from pump 154 provides coverage of dishes and other dishwasher contents with a washing spray. Other configurations of spray assemblies may be used as well.

The dishwasher 100 is further equipped with a controller 137 to regulate operation of the dishwasher 100. The controller may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown in FIGS. 1 and 2. In some such embodiments, input/output ("I/O") signals may be routed between the controller 137 and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In some embodiments, the user interface 136 represents a general purpose I/O ("GPIO") device or functional block. In additional or alternative embodiments, the user interface 136 includes input components, such as one or more of a variety of electrical, mechanical, or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, and other differences may be applied as well.

Figure 3:
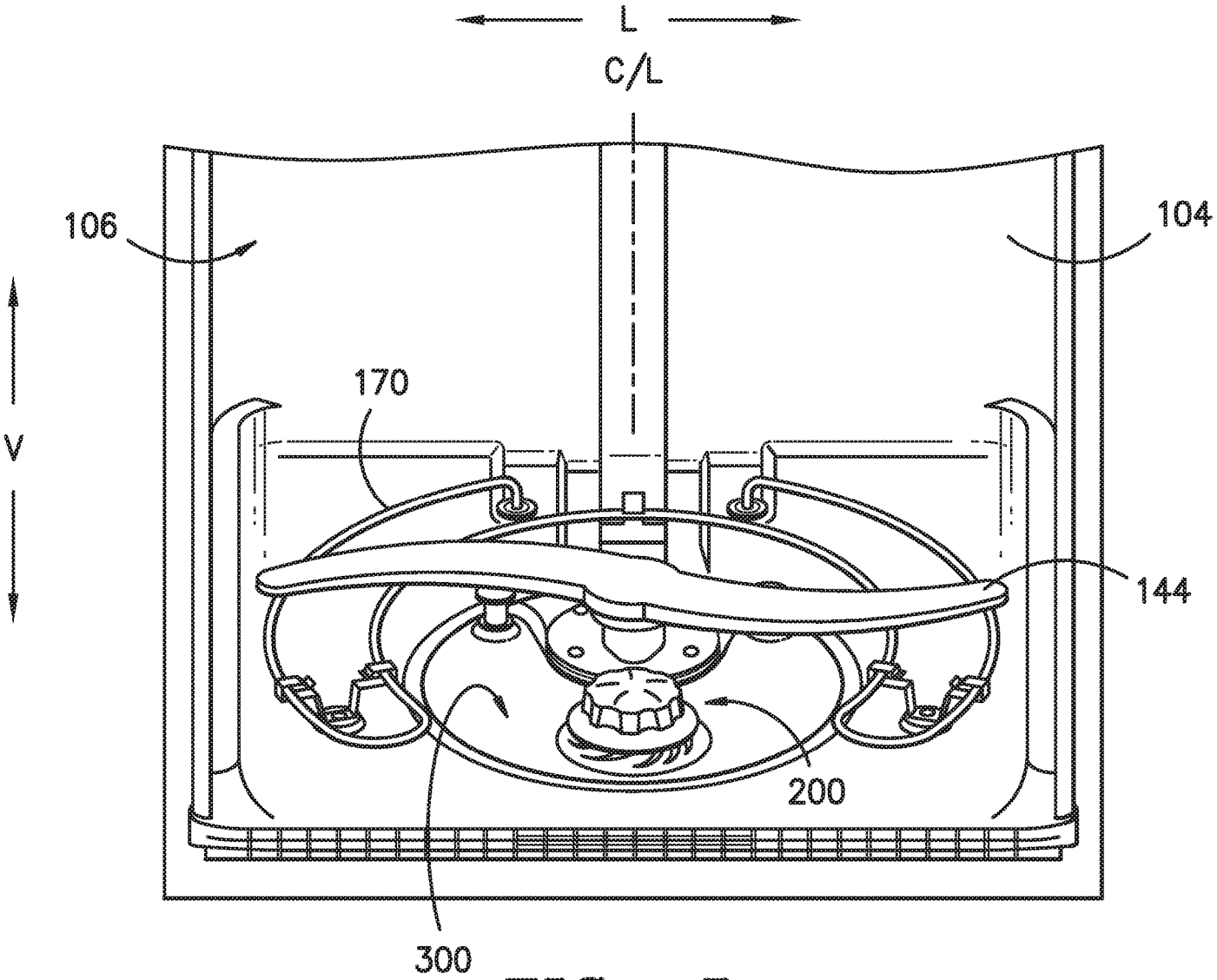
FIG. 3 provides a cut away perspective view of the bottom interior surface of an exemplary dishwasher appliance.
Figure 4:
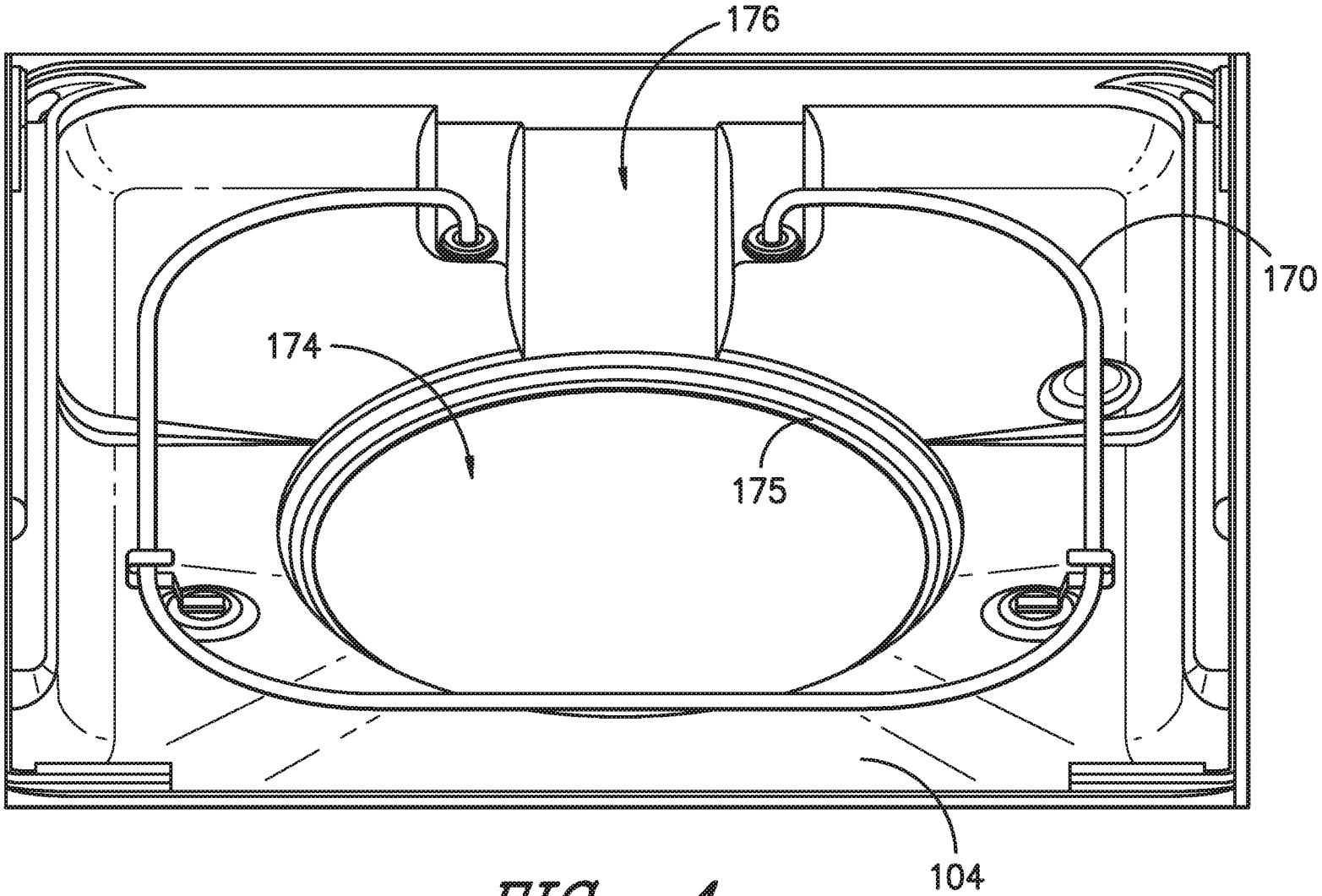
FIG. 4 provides another perspective view of the bottom interior surface of an exemplary dishwasher appliance with the tub sump assembly removed.

Referring now to FIGS. 2, 3, and 4, an exemplary filtering system 200 may be located in sump assembly 300 (e.g., to provide filtered fluid to pump inlet 162). Generally, filtering system 200 can remove soiled particles from the fluid that is recirculated through the wash chamber 106 during operation of dishwasher 100. In exemplary embodiments, filtering system 200 includes both a first filter 202 (also referred to as a "coarse filter") and a second filter 204 (also referred to as a "fine filter"). In certain other embodiments of the present invention, dishwasher 100 may not include filter 202 and, instead, may include only filter 204 having a plurality of different filter media as further described below.

Based on the shape of sump assembly 300 (see FIG. 2), fluid may flow down along vertical direction V to filtering system 200 for filtration during use. After the fluid is filtered by passing through first filter 202 (e.g., a coarse filter) or second filter 204 (e.g., a fine filter), the filtered fluid is fed to the inlet 162 of pump 154 for return to the wash chamber 106 by way of fluid circulation assembly 152. After being sprayed onto articles in the dishwashing appliance using one or more of spray elements 144, 148, and 150, the fluid may eventually flow to sump assembly 300 (e.g., to be filtered again).

Filtered waste material can be removed from filter assembly 200 by a drain pump 208 feeding drain 210. Accordingly, filtering system 200 acts to clean soil particles from the fluid so as to e.g., protect pump 154 and/or the spray assemblies from clogging as the fluid is recirculated during the cleaning process of the dishwashing appliance 100 such as e.g., a wash or rinse cycle of appliance 100. The filter assembly 200 can also provide a cleaner fluid during the cleaning process, which results in cleaner articles.

As shown, tub sump assembly 300 may be mounted into tub 104 from within wash chamber 106. Specifically, as shown in FIG. 4, an interior bottom surface 176 of tub 104 includes a tub opening 174. In some embodiments, tub opening 174 is defined by a tub lip 175. For example, tub lip 175 extending below interior bottom surface 176 of tub 104 and defining tub opening 174. In some such embodiments, tub lip 175 is sized such that tub opening 174 is slightly smaller than the circumference (or width) of tub sump assembly 300, thereby preventing tub sump assembly 300 from passing through the tub opening 174 or facilitating a tight seal between tub 104 and tub sump assembly 300 to prevent leaks.

Figure 5:
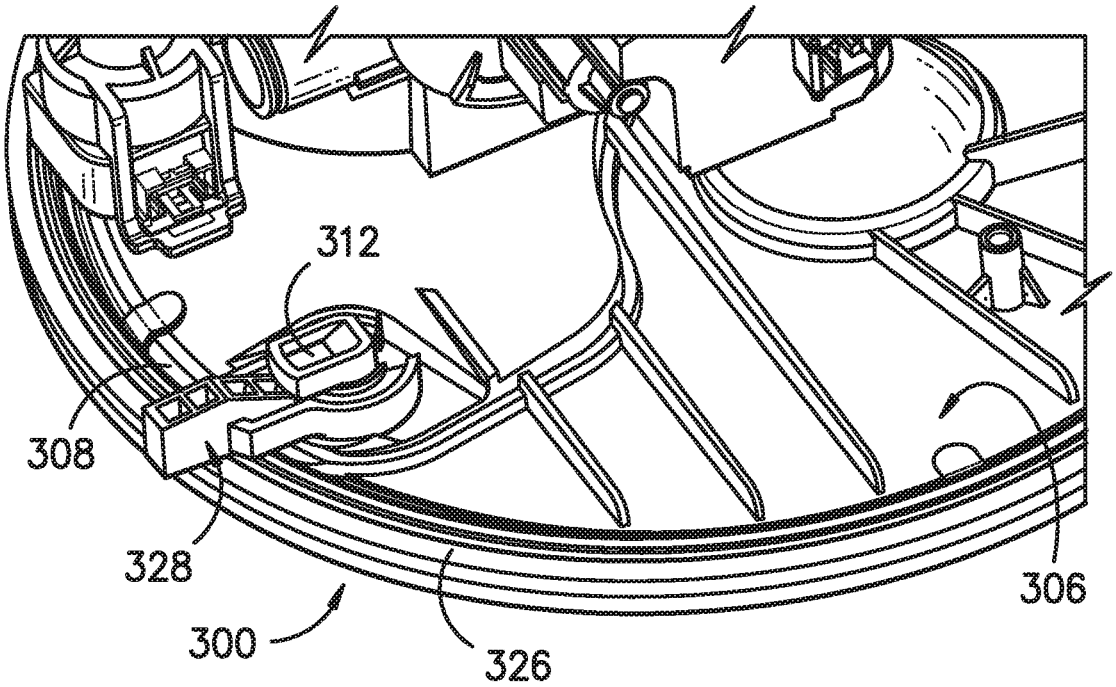
FIG. 5 provides a perspective view of the bottom side of an exemplary embodiment of a tub sump assembly with attached latches in an extended position.
Figure 6:
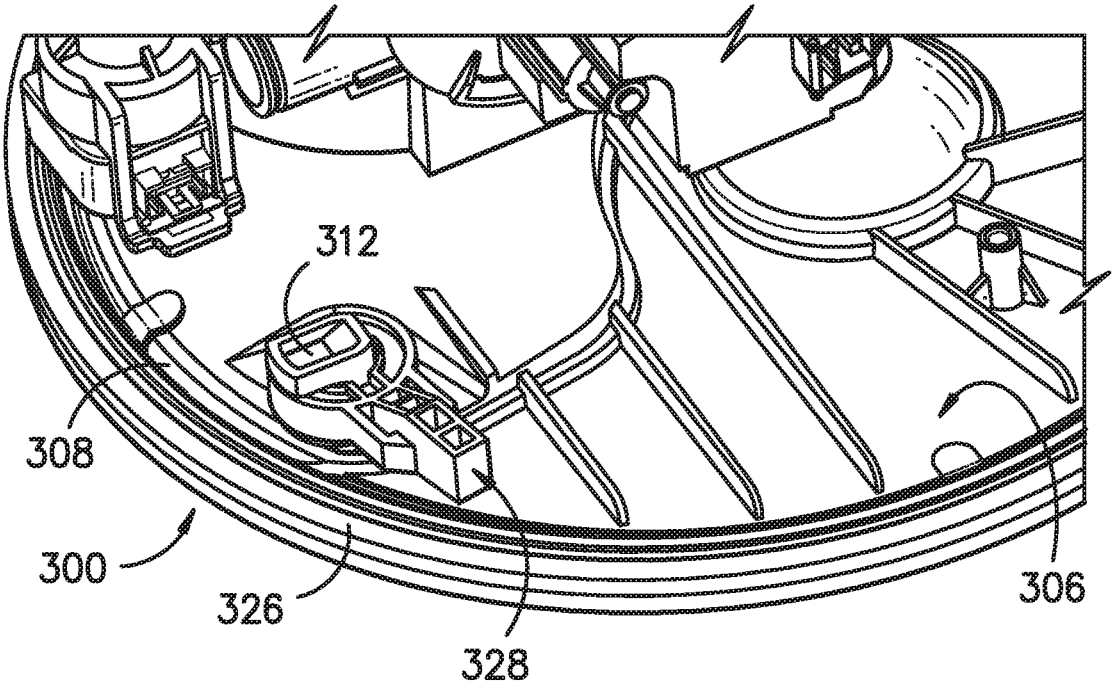
FIG. 6 provides a perspective view of the bottom side of an exemplary embodiment of a tub sump assembly with attached latches in a retracted position.
Figure 7:
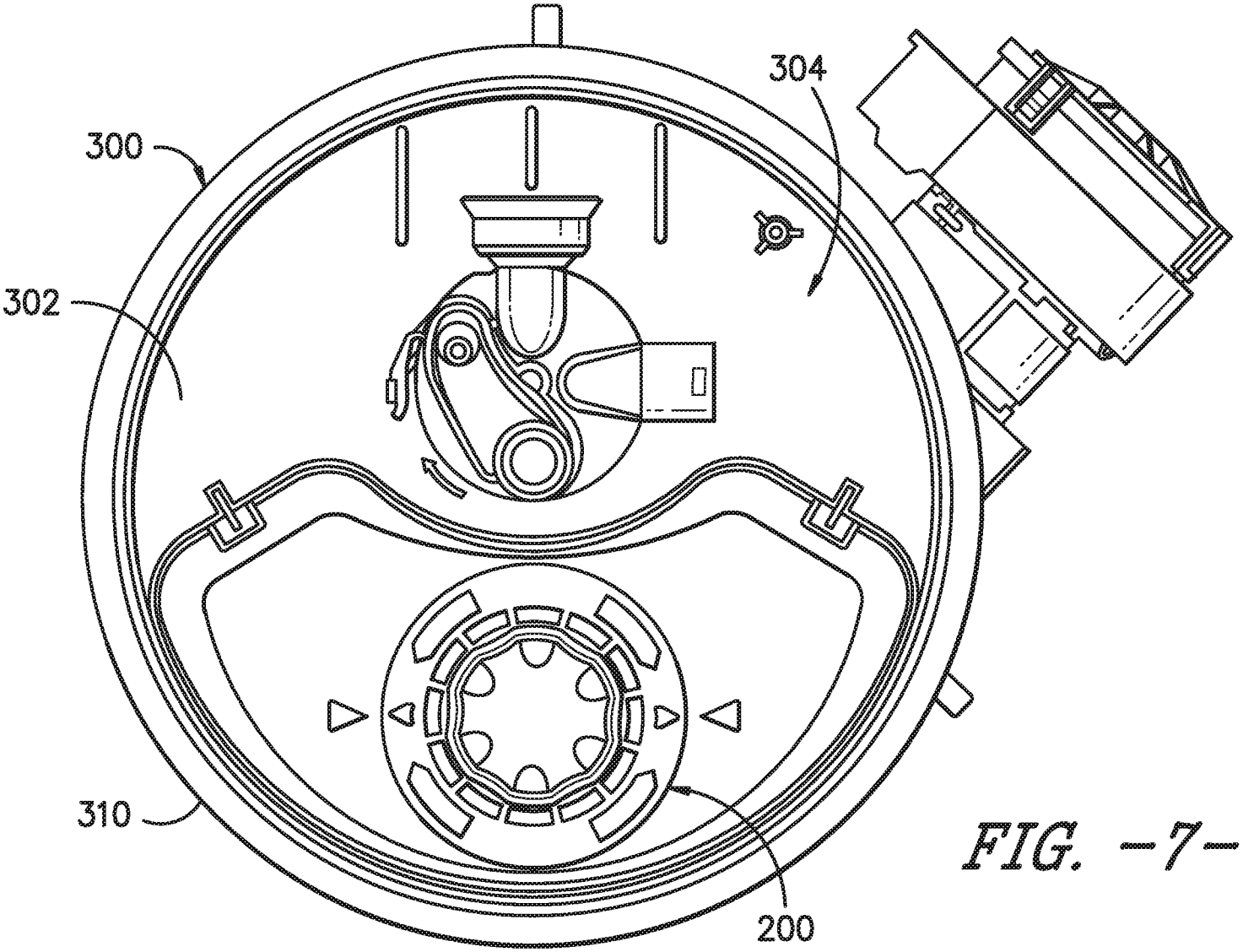
FIG. 7 provides a perspective view of the top side of an exemplary embodiment of a tub sump assembly.

The tub sump assembly 300 is now discussed in greater detail with reference to FIGS. 5 through 7. FIGS. 5 and 6 show perspective views of, for example, from below tub sump assembly 300. FIG. 7 provides a top view of an exemplary embodiment of tub sump assembly 300. The tub sump assembly 300 includes a sump 302, a seal 326, and one or more latches 328. Generally, sump 302 includes a top side 304, a bottom side 306, a side 308 extending between top side 304 and bottom side 306, and a lip 310 extending around side 308 such that lip 310 extends beyond bottom side 306 at all points along side 308 of sump 302. One or more latch receivers 312 may be attached to the bottom side 306 of sump 302. Additionally or alternatively, the seal 326 may be arranged around side 308 of sump 302. In various embodiments, seal 326 may comprise a gasket, an o-ring, an adhesive, or any other suitable sealing element known to those skilled in the art.

Figure 17:
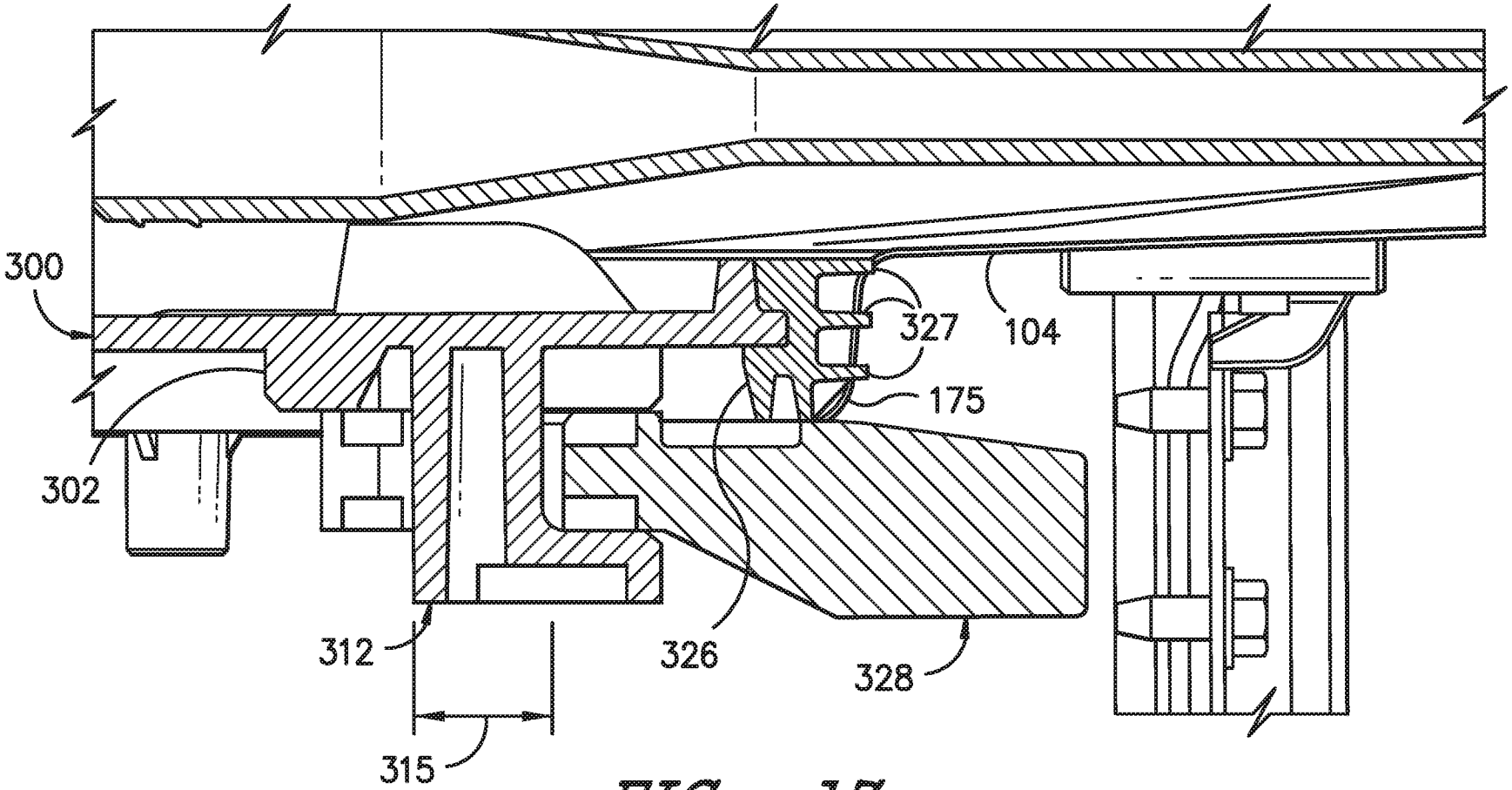
FIG. 17 provides a schematic side view of a portion of an exemplary tub sump assembly with a latch in the extended position.

As depicted in FIG. 6, in some embodiments, one or more latches 328 are connected to the one or more latch receivers 312. As further shown in FIG. 5, latches 328 may rotate about corresponding latch receivers 312 to an extended position (e.g., overhanging the side 308 of sump 302 or, as shown in FIG. 17, abutting tub lip 175). With tub sump assembly 300 resting on tub lip 175, rotation of latches 328 may compress seal 326 against tub lip 175, forming a seal that prevents wash fluid from leaking from tub 104 through tub opening 174. Additionally or alternatively, compression between seal 326 and tub lip 175 may stabilize the position of tub sump assembly 300 with respect to tub 104.

Referring to FIG. 7, as installed, top side 304 of sump 302 is exposed to wash chamber 106 within tub 104. Filter system 200 is attached to sump 302 (e.g., at top side 304), allowing wash fluid from operation of dishwasher 100 to flow over top side 304 of sump 302 and into filter system 200, where the wash fluid may be filtered and recycled for further use during the wash cycle.

Figure 8:
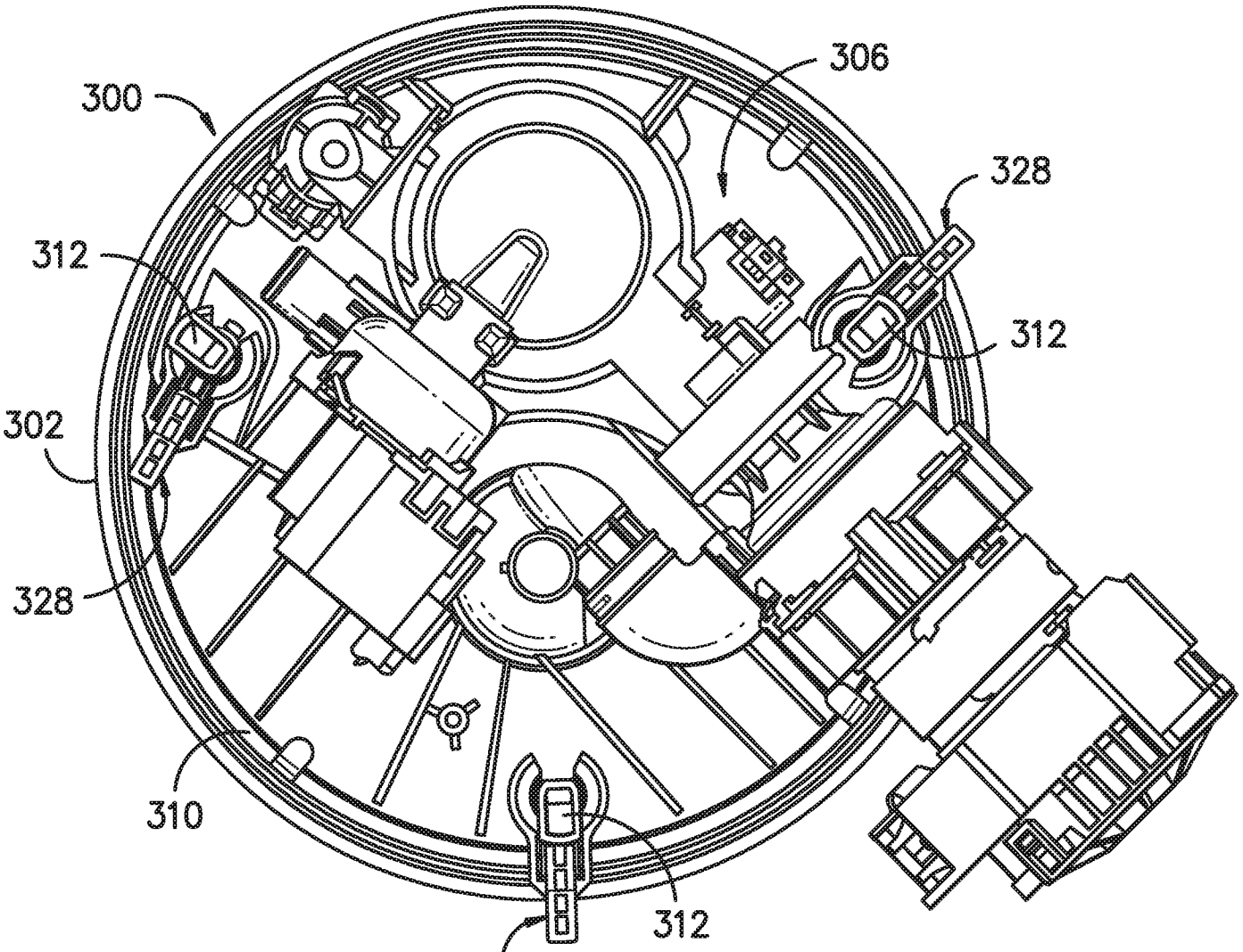
FIG. 8 provides a top view of the bottom side of an exemplary tub sump assembly with attached latches in varying positions.

FIG. 8 provides a bottom view of an embodiment of sump 302, showing bottom side 306 of sump 302. In some embodiments, bottom side 306 of sump 302 includes one or more latch receivers 312. Latch receivers 312 may be an integral element of the molded bottom side 306 of sump 302 or, alternatively, may be separate elements attached to bottom side 306 of sump 302 through a suitable mechanical fastener, adhesive, etc. When assembled, latch receivers 312 may be situated near the side 308 of sump 302 such that, when latch 328 is attached to and rotated about latch receiver 312, latch 328 notably extends beyond the side 308 of sump 302.

In some embodiments, such as that shown in FIG. 8, bottom side 306 of sump 302 includes multiple (e.g., three) latch receivers 312 spaced apart from one another in order that, when latches 328 are rotated about latch receivers 312, seal 326 is compressed against tub lip 175 in each of these locations. Notably, latch receivers 312 (e.g., including the mutual spacing thereof) may ensure that seal 326 is compressed against tub lip 175 around the entire side 308 of sump 302, ensuring a proper seal to prevent leakage.

Figure 9:
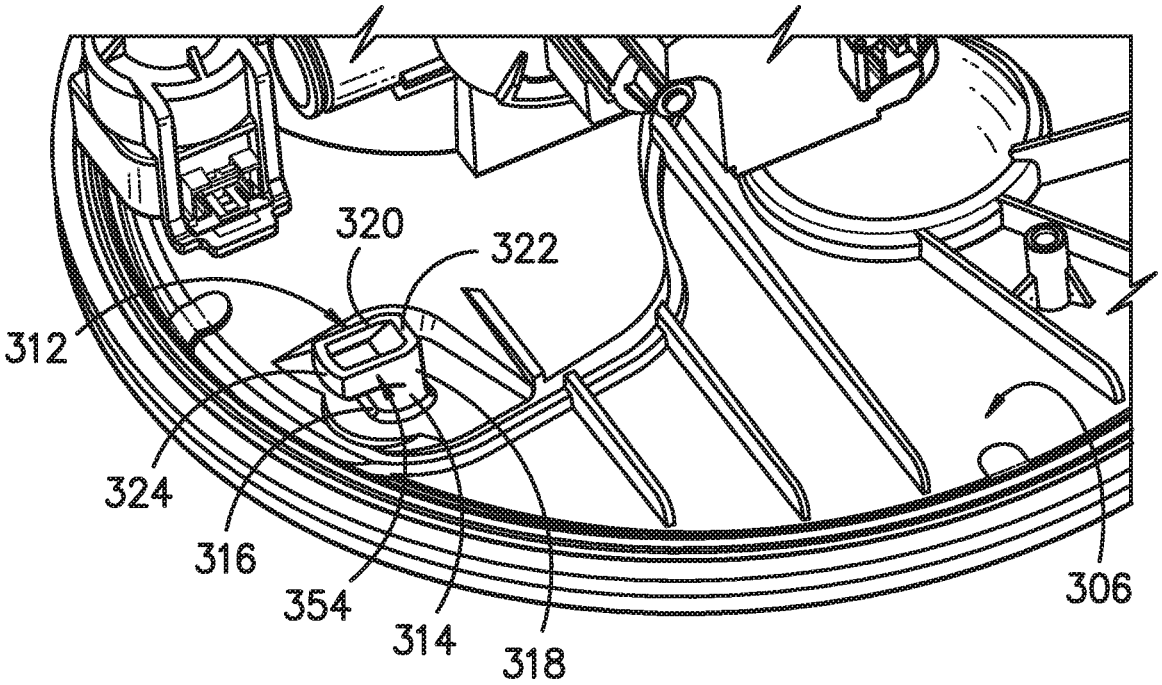
FIG. 9 provides a perspective view of an exemplary embodiment of a latch receiver.
Figure 10:
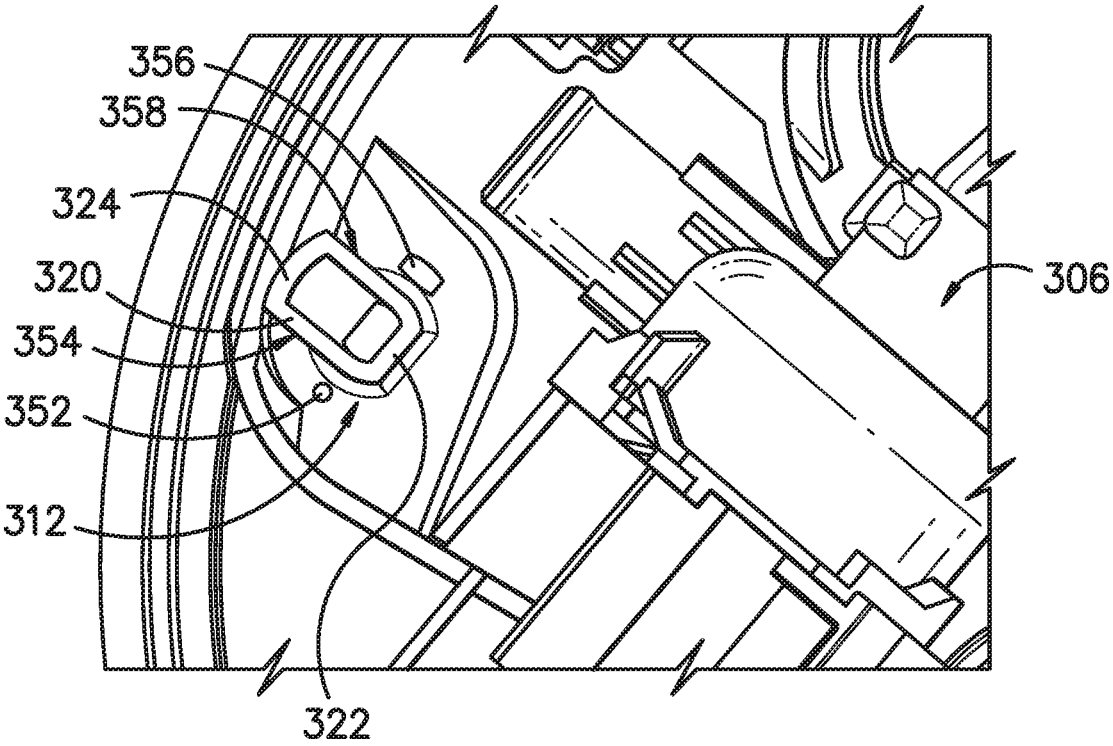
FIG. 10 provides a top view of an exemplary embodiment of a latch receiver.
Figure 11:
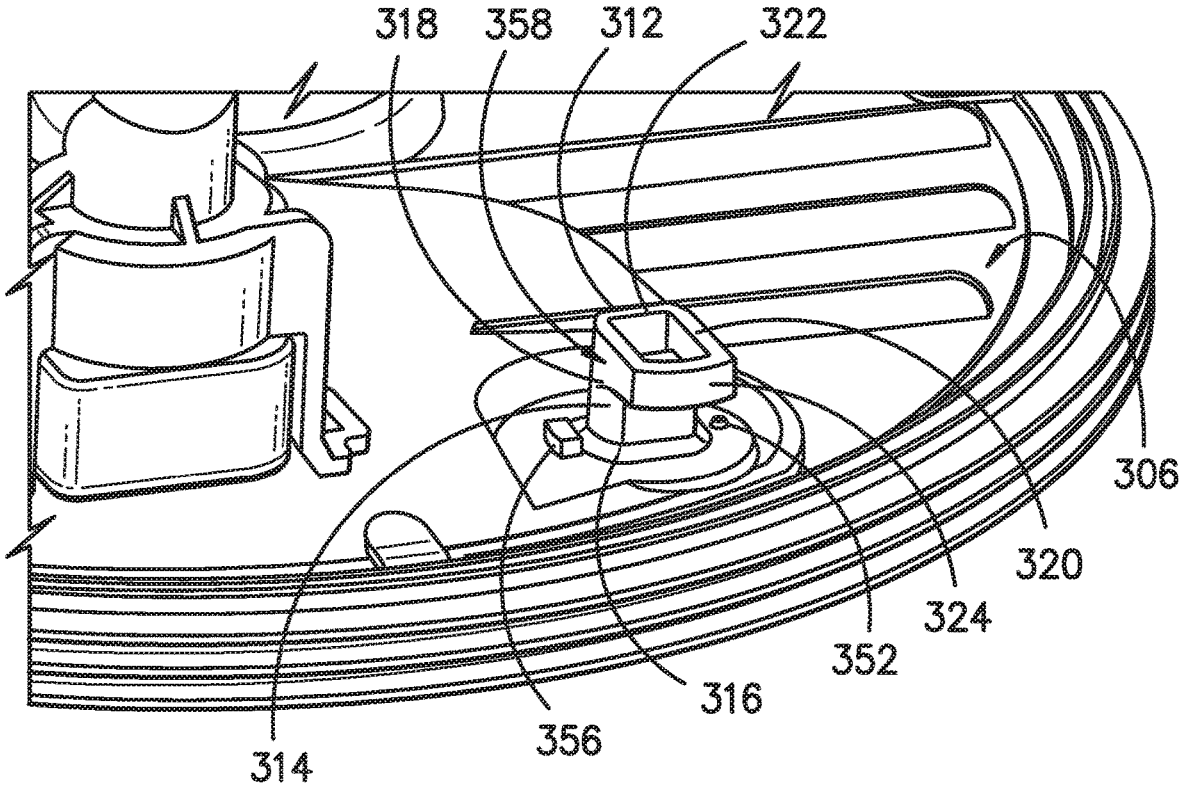
FIG. 11 provides a different perspective view of an exemplary embodiment of a latch receiver on the bottom side of a sump.

Turning now to FIGS. 9 through 11, each latch receiver 312 may include a latch post 314. Latch post 314 may include a first post end 316 connected to bottom side 306 of sump 302 and a second post end 318 that is displaced from bottom side 306 of sump 302. Latch receiver 312 may serve as an anchor upon which latch 328 may be mounted and about which latch 328 may be rotated. In some embodiments, latch post 314 is oriented perpendicular to bottom side 306 of sump 302. Additionally, in at least some embodiments, at least of portion of the surface of latch post 314 may be rounded to facilitate rotation of latch 328 about latch post 314. For instance, latch post 314 may be cylindrical or partially cylindrical, having a diameter 315 (as shown in FIG. 17). Alternatively, other embodiments include a latch post 314 having at least a partially segmented surface such that a cross-section of latch post 314 forms at least a partial hexagon, octagon, or other multi-faced surface. As illustrated, latch post 314 may have sufficient height to accommodate the entire height of latch 328.

As shown (e.g., in FIGS. 9 through 11), latch receiver 312 may further include a latch retainer 320 having a first retainer end 322 connected (e.g., integrally or, alternatively, separably) to the second post end 318 of latch post 314 and a second retainer end 324 extending outward toward side 308 of sump 302. In certain embodiments, after latch 328 is attached to latch post 314, at least a portion of latch 328 may be contained between bottom side 306 of sump 302 and latch retainer 320. Further, after latch 328 is rotated to an extended position and is subjected to the forces created by compression of seal 326, latch retainer 320 may resist the force translated through latch 328, preventing latch 328 from sliding off of latch post 314.

Bottom side 306 of sump 302, in some embodiments, includes a first protrusion 352 on a first side 354 of latch receiver 312 and a second protrusion 356 on a second side 358 of latch receiver 312, as shown in FIGS. 9 through 11. In exemplary embodiments, first protrusion 352 and second protrusion 356 are integrally molded (e.g., unitary and monolithic) aspects of bottom side 306 of sump 302.

As previously noted, latch receivers 312 may be used, for example, to attach latches 328 to sump 302. FIGS. 12 through 16 provide various views of an exemplary embodiment of latch 328. In exemplary embodiments, latch 328 is made from plastic (e.g., natural or synthetic polymer). Latch 328 may include, for instance, a latch head 330 for attaching latch 328 to latch post 314 of latch receiver 312. Latch 328 may further include a latch handle 332 connected to latch head 330 for use in rotating latch 328 about latch post 314 of latch receiver 312.

Figure 12:
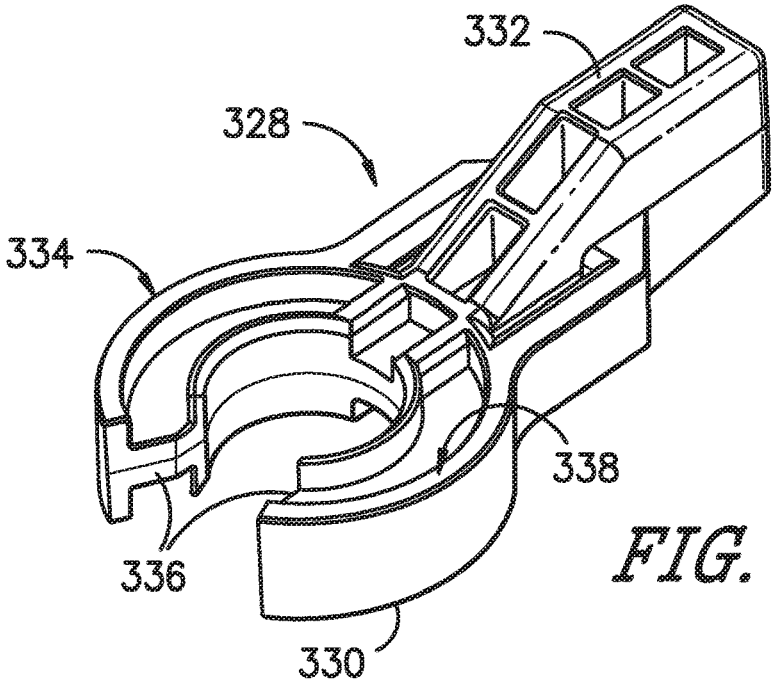
FIG. 12 provides a perspective view of an exemplary latch.
Figure 13:
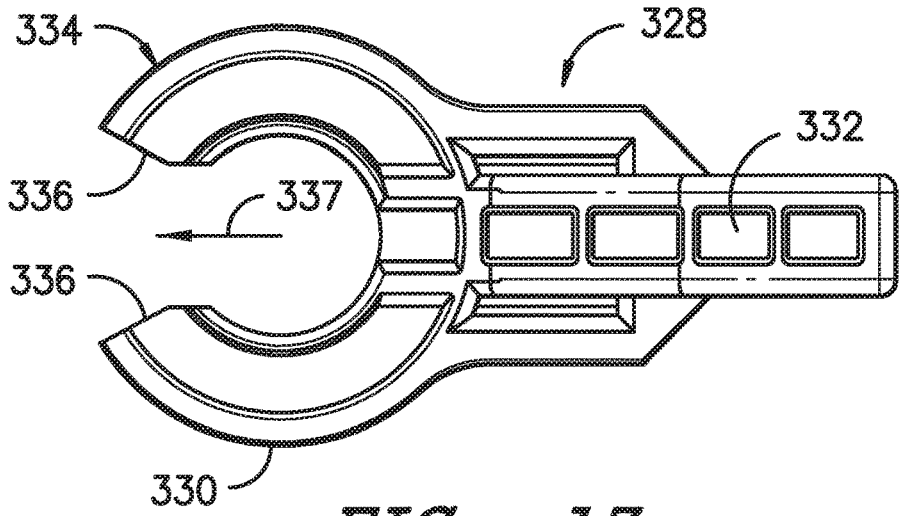
FIG. 13 provides a top view of an exemplary latch.
Figure 14:
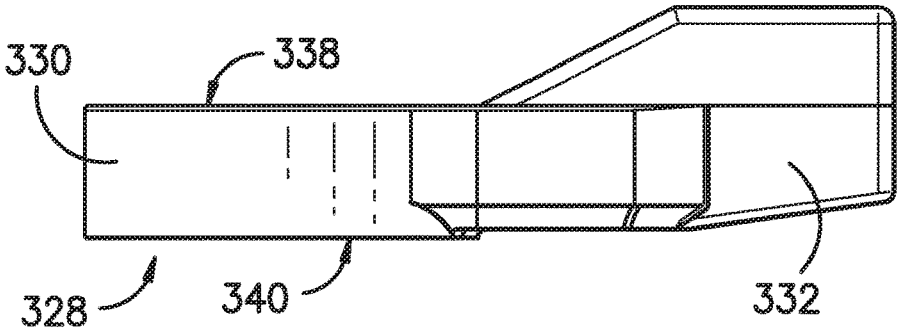
FIG. 14 provides a side view of an exemplary latch.

In some embodiments, such as those shown in FIGS. 12 through 16, latch head 330 may be a partial circular ring 334 forming two jaws 336 between which is a latch head opening 337 (FIG. 13). Jaws 336 may be oriented such that latch head opening 337 between jaws 336 is opposite from the location where latch handle 332 is mounted to latch head 330. Latch head opening 337 between jaws 336 may be sized so that a width of latch head opening 337 is smaller than the width or diameter 315 of latch post 314, such that jaws 336 must expand apart from one another in order to attach latch head 330 to latch post 314. On the other hand, the width of latch head opening 337 between jaws 336 may not be so small that the required expansion of jaws 336 would result in damage to latch head 330. In certain embodiments (e.g., as shown in FIGS. 12 through 16), the partial circular ring 334 may also have an interior diameter 333 (FIG. 16) sized to accommodate the width or diameter 315 of latch post 316. When the dimensions of latch head 330 are sized as such, latch 328 may be rotatably attached to latch post 316 of latch receiver 312 and latch post 316 will provide resistance against the removal of latch 328.

Figure 15:
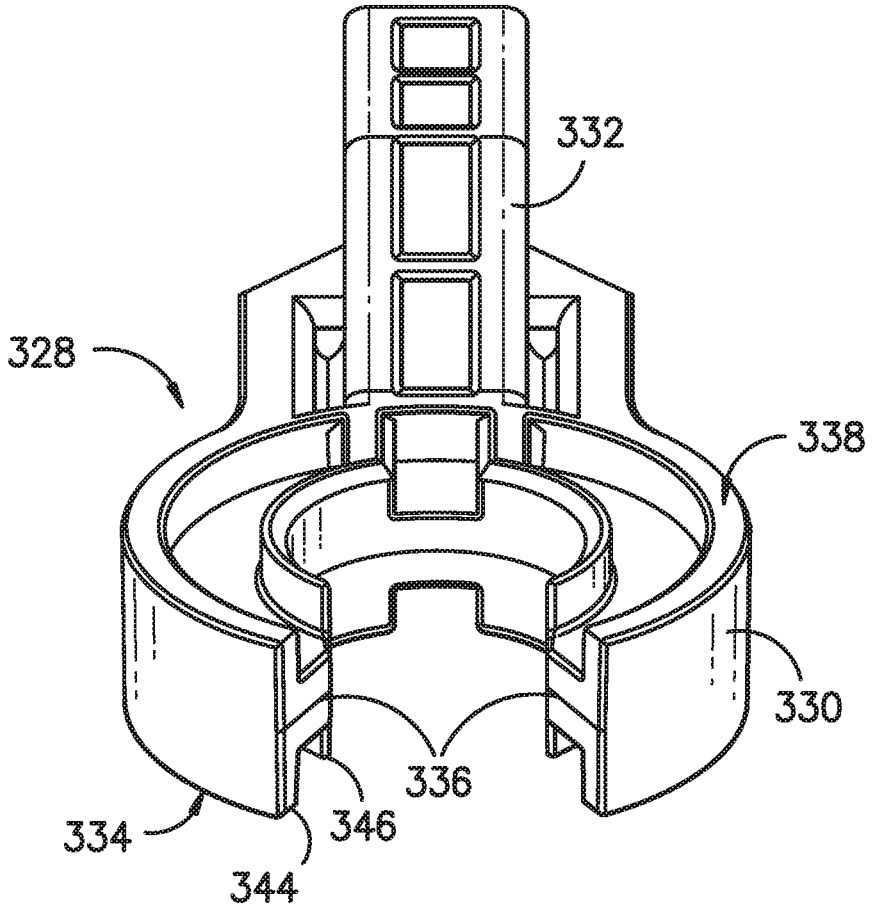
FIG. 15 provides a front perspective view of an exemplary latch.
Figure 16:
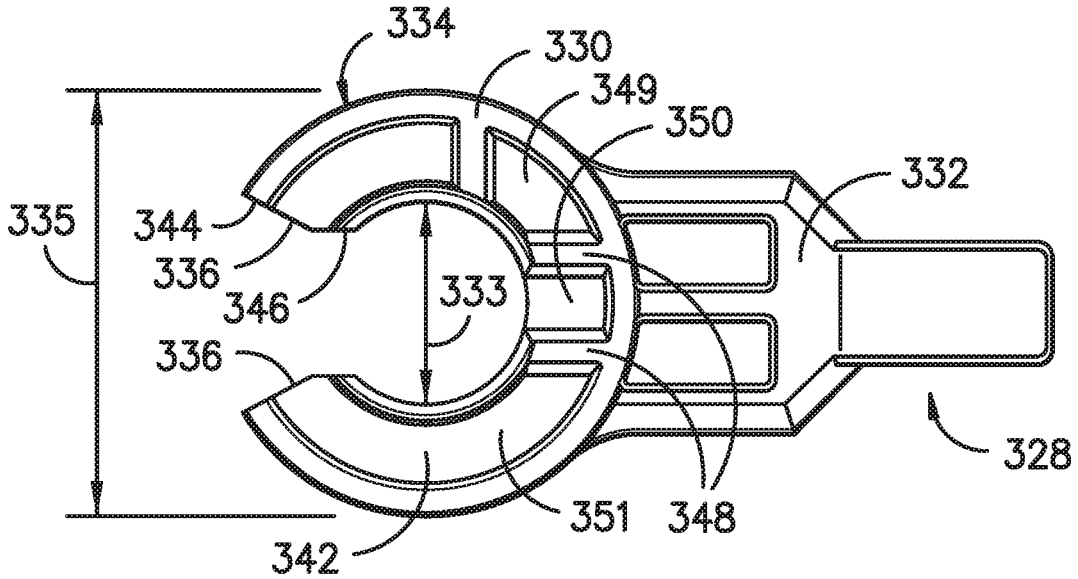
FIG. 16 provides a bottom view of an exemplary latch.

Additionally or alternatively, latch head 330 may have a top side 338 (e.g., as shown in FIGS. 12, 13, and 15) and a bottom side 340 (e.g., as shown in FIG. 16). Bottom side 340 of latch head 330, in certain embodiments, includes an outer ridge 344 raised along an outer diameter 335 of partial circular ring 334 (FIGS. 15, 16). In addition, bottom side 340 of latch head 330 may include an inner ridge 346 raised along inner diameter 333 of partial circular ring 334 (FIGS. 15, 16). Together, outer ridge 344 and inner ridge 346 form a groove 342 along partial circular ring 334 (e.g., on the bottom side 340 of latch head 330). In some embodiments, groove 342 extends along jaw 336 from latch head opening 337 in partial circular ring 334 to a stop bar 348, which may be a raised element connecting outer ridge 344 and inner ridge 346. (FIG. 16).

In some embodiments, stop bar 348 may be situated in proximity to the location where latch head 330 and latch handle 332 connect. Additionally, certain embodiments may include two stop bars 348 spaced apart from one another such that stop bars 348 and one or more of outer ridge 344 and inner ridge 346 form a recessed first latch pocket 350 (e.g., as depicted in the bottom view of FIG. 16) where latch head 330 is connected to latch handle 332. Similarly, one or more of stop bars 348 and one or more of outer ridge 344 and inner ridge 346 form a second latch pocket 349 and a third latch pocket 351, one each on the opposite sides of stop bars 348 from first latch pocket 350. When latch 328 is attached to latch post 324 of latch receiver 312, the bottom side 340 of latch head 330 faces the bottom side 306 of sump 302. Thus, when latch head 330 is attached to latch post 324, first latch pocket 350 may be positioned over first protrusion 352 on sump 302.

In some embodiments, latch 328 may extend beyond side 308 of sump 302 when initially attached. In such circumstances, latch 328 must then be rotated after initial attachment to latch receiver 312 such that latch handle 332 is moved away from side 308 of sump 302. Latch 328 may be initially attached to first side 354 of latch receiver 312 and rotation of latch 328 results in first protrusion 352 being contained within second latch pocket 349. This containment of first protrusion 352 within either second latch pocket 349 or third latch pocket 351 impedes unintentional rotation of latch 328 about latch post 314 and holds latch 328 in an open position until tub sump assembly 300 is ready to be mounted within tub 104. Alternatively, sump 302 may be designed such that first protrusion 352 is located on second side 358 of latch receiver 312 and second protrusion 356 is located on first side 354 of latch receiver (not pictured, in which case latch 328 may be initially attached to second side 358 of latch receiver 312 and rotation of latch 328 results in first protrusion 352 being contained within third latch pocket 351, once again impeding rotation of latch 328 and maintaining it in an open position. In yet another alternative embodiment in which latch 328 does not extend beyond side 308 of sump 302 following initial attachment to latch receiver 312, first latch pocket 350 may itself contain first protrusion 352 in order to impede rotation of latch 328 and maintain latch 328 in an open position.

Once tub sump assembly 300 is placed within tub opening 174 of tub 104 and latch 328 is attached to latch post 314, latch 328 may be rotated about latch post 314 to an extended position (e.g., as shown in FIG. 5). As latch 328 rotates about latch post 314, groove 342 on the bottom side 340 of latch head 330 slides over second protrusion 356 (e.g., shown in FIG. 11), which remains within groove 342 during rotation of latch 328. Rotation of latch 328 may continue until second protrusion 356 makes contact with stop bar 348, which marks the end of groove 342 (e.g., as shown in FIG. 16). In this way, a user or installer may confirm that latch 328 is properly aligned in the extended position.

Figure 18:
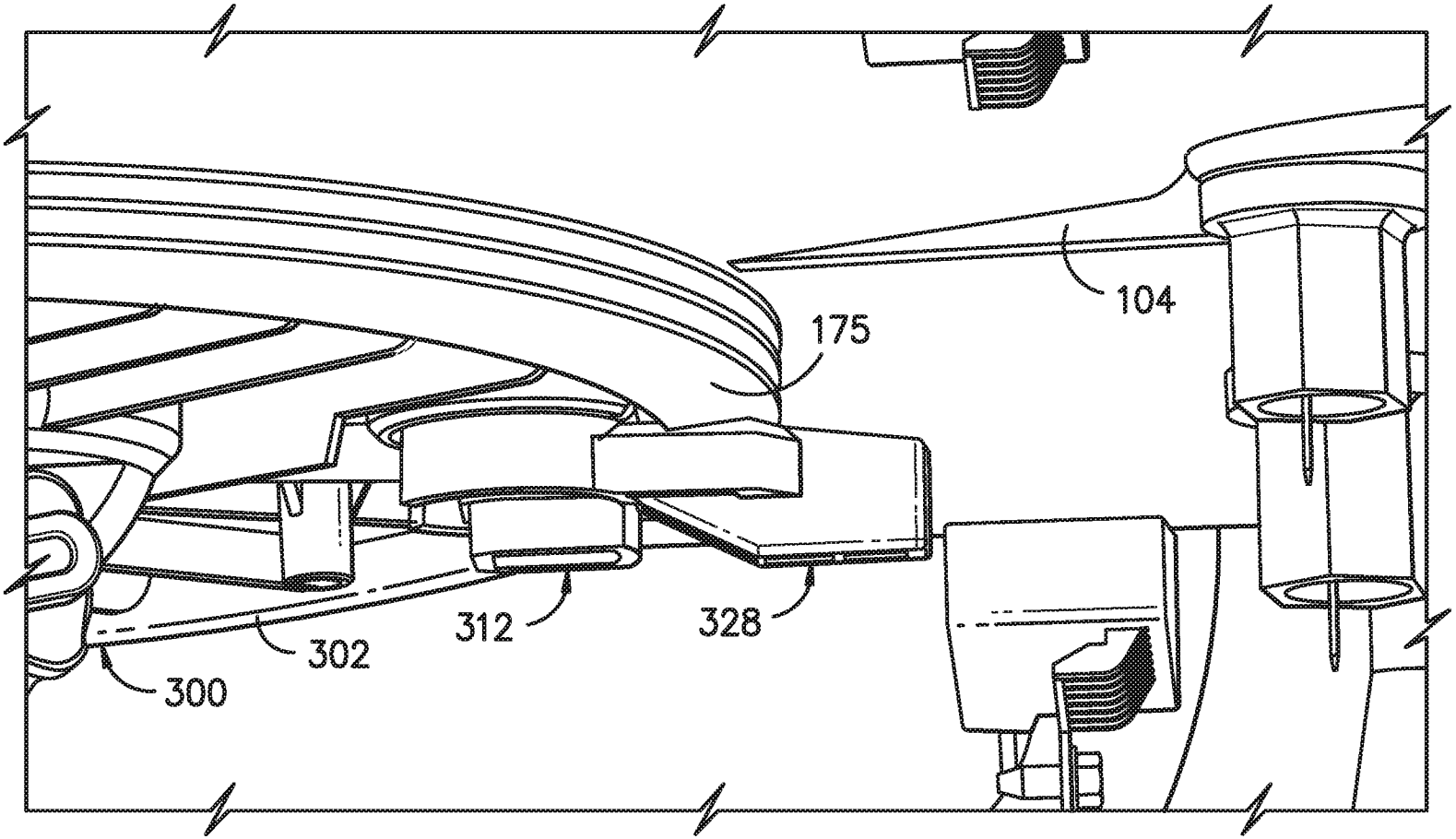
FIG. 18 provides a bottom perspective view of a portion of an exemplary tub sump assembly with a latch in the extended position.

As further shown in FIGS. 17-18, rotation of latch 328 may result in contact between latch 328 and tub lib 175, such that compression of seal 326 is necessary in order for latch 328 to reach the extended position. As shown in FIG. 17, and as previously explained, seal 326 extends around side 308 of sump 302. It should be understood that at least a portion of seal 326 may extend below lip 310 of sump 302, in order that sump 302 is able to compress seal 326 upon rotation of latch 328. In certain embodiments, such as the embodiment of FIG. 17, tub lip 175 includes a plurality of horizontal slots or recesses such that, when seal 326 is compressed by the action of latch 328, such slots or recesses may be occupied by corresponding ribs 327 on the exterior of seal 326, thereby resulting in an interference fit and aiding in the prevention of leakage between the inside and outside of tub 104.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A sump mounting assembly comprising:
- a sump including;
  - a top side;
  - a bottom side;
  - a side extending between the top side and the bottom side;
- a latch receiver connected to the bottom side, the latch receiver including;
  - a cylindrical latch post having a first post end connected to the bottom side and a second post end displaced from the bottom side; and
  - a latch retainer having a first retainer end connected to the second post end and a second retainer end;
  - a seal extending around the side; and
  - a latch rotatably mounted to the latch receiver, the latch comprising
    - a latch head for attaching the latch to the latch post, the latch head comprising a partial circular ring forming two jaws between which is a latch head opening;
    - a latch handle connected to the latch head for use in rotating the latch head about the latch handle such that at least a portion of the latch handle extends beyond the side of the sump and seal; and
  - wherein the latch head opening is opposite the latch handle for permitting the latch head to be attached to the latch post.

2. The sump mounting assembly of claim 1, wherein the latch is made of plastic.

3. The sump mounting assembly of claim 2, wherein the latch head opening is sized such that the jaws must expand apart from one another in order to attach the latch head to the latch post.

4. The sump mounting assembly of claim 1, wherein an interior diameter of the partial circular ring is sized to accommodate a diameter of the cylindrical latch post.

5. The sump mounting assembly of claim 4, wherein the latch head has a top side and a bottom side, the bottom side having a groove along the partial circular ring defined by an outer ridge along an exterior diameter of the partial circular ring and an inner ridge along the interior diameter of the partial circular ring.

6. The sump mounting assembly of claim 5, wherein the bottom side of the latch head further includes two raised stop bars connecting the outer ridge and the inner ridge, thereby interrupting the grooves of the partial circular ring, the stop bars being spaced apart from one another such that one or more stop bars and one or more of the outer ridge and the inner ridge form a latch pocket where the latch head is connected to the latch handle.

7. The sump mounting assembly of claim 6, wherein the bottom side of the sump further includes a first protrusion on a first side of the latch receiver, such that when the latch head is attached to the latch post, the first protrusion is contained within the latch pocket, thereby impeding rotation of the latch.

8. The sump mounting assembly of claim 7, wherein the bottom side of the sump further includes a second protrusion on a second side of the latch receiver opposite the first protrusion, such that the latch may be rotated about the latch post, wherein the second protrusion remains within the groove on the bottom side of the latch head, until the second protrusion contacts one or more of the stop bars, preventing further rotation of the latch.

9. A dishwasher appliance comprising:
- a cabinet having a front cabinet opening;
- a hinged door for accessing and sealing the front cabinet opening;
- a wash tub that defines a wash chamber, the wash tub including;
  - an interior bottom surface, the interior bottom surface having a tub opening; and
  - a tub lip extending below the interior bottom surface and defining the tub opening;
- one or more spray assemblies for introducing wash fluids into the wash chamber; and
- a sump mounting assembly, which rests atop the tub lip, and which includes;
  - a sump including;
    - a top side;
    - a bottom side; and
    - a side extending between the top side and the bottom side;
  - a latch receiver connected to the bottom side, the latch receiver including;
    - a latch post having a first post end connected to the bottom side of the sump and a second post end displaced from the bottom side of the sump;

a latch retainer having a first retainer end connected to the second post end and a second retainer end;

a seal extending around the side; and a latch rotatably mounted to the latch receiver and including;

a latch head for attaching the latch to the latch post; and a latch handle connected to the latch head for use in rotating the latch head about the latch post to an extended position such that the latch handle extends beyond the side of the sump;

wherein rotation of the latch to an extended position compresses the seal against the tub lip, thereby preventing leaks through the tub opening.

10. The dishwasher appliance of claim 9, wherein the latch post is cylindrical.

11. The dishwasher appliance of claim 10, wherein the latch further comprises:

a latch head for attaching the latch to the latch post, the latch head comprising a partial circular ring forming two jaws between which is a latch head opening;

a latch handle connected to the latch head for use in rotating the latch head about the latch handle such that at least a portion of the latch handle extends beyond the side of the sump and seal; and wherein the latch head opening is opposite the latch handle for permitting the latch head to be attached to the latch post.

12. The dishwasher appliance of claim 11, wherein the latch is made of plastic.

13. The dishwasher appliance of claim 12, wherein the latch head opening is sized such that the jaws must expand apart from one another in order to attach the latch head to the latch post.

14. The dishwasher appliance of claim 11, wherein an interior diameter of the partial circular ring is sized to accommodate a diameter of the cylindrical latch post.

15. The dishwasher appliance of claim 14, wherein the latch head has a top side and a bottom side, the bottom side having a groove along the partial circular ring defined by an outer ridge along an exterior diameter of the partial circular ring and an inner ridge along the interior diameter of the partial circular ring.

16. The dishwasher appliance of claim 15, wherein the bottom side of the latch head further includes two raised stop bars connecting the outer ridge and the inner ridge, thereby interrupting the grooves of the partial circular ring, the stop bars being spaced apart from one another such that one or more stop bars and one or more of the outer ridge and the inner ridge form a latch pocket where the latch head is connected to the latch handle.

17. The dishwasher appliance of claim 16, wherein the bottom side of the sump further includes a first protrusion on a first side of the latch receiver, such that when the latch head is attached to the latch post, the first protrusion is contained within the latch pocket, thereby impeding rotation of the latch.

18. The dishwasher appliance of claim 17, wherein the bottom side of the sump further includes a second protrusion on a second side of the latch receiver opposite the first protrusion, such that the latch may be rotated about the latch post, wherein the second protrusion remains within the groove on the bottom side of the latch head, until the second protrusion contacts one or more of the stop bars, preventing further rotation of the latch.

* * * * *